United States Patent [19]

Fladby

[11] 4,127,362

[45] Nov. 28, 1978

[54] REGULATING THE FLOW CAPACITY OF A POSITIVE DISPLACEMENT PUMP BY CONTROLLING INLET VALVE MEANS

[75] Inventor: Tron-Halvard Fladby, Asker, Norway

[73] Assignee: A/S Akers Mek. Verksted, Oslo, Norway

[21] Appl. No.: 802,143

[22] Filed: May 31, 1977

[30] Foreign Application Priority Data

May 31, 1976 [NO] Norway ..... 761844

[51] Int. Cl.[2] ..... F04B 49/02

[52] U.S. Cl. ..... 417/53; 417/298; 417/447

[58] Field of Search ..... 417/298, 283, 445, 446, 417/447, 507, 508, 295, 53

[56] References Cited

U.S. PATENT DOCUMENTS

| | | | |
|---|---|---|---|
| 1,623,489 | 4/1927 | Naab | 417/446 |
| 2,936,106 | 5/1960 | Larsson et al. | 417/298 |

FOREIGN PATENT DOCUMENTS

| | | | |
|---|---|---|---|
| 683,594 | 10/1939 | Fed. Rep. of Germany | 417/298 |
| 914,770 | 5/1954 | Fed. Rep. of Germany | 417/298 |
| 1,528,589 | 1/1970 | Fed. Rep. of Germany | 417/298 |
| 251,934 | 6/1926 | United Kingdom | 415/295 |

*Primary Examiner*—Carlton R. Croyle
*Assistant Examiner*—Thomas I. Ross
*Attorney, Agent, or Firm*—Watson, Cole, Grindle & Watson

[57] ABSTRACT

A piston pump includes a fluid flow control system positioned between the fluid intake duct and the intake aperture of the piston cylinder, the control system including a cylindrical sleeve which is in fluid communication with the intake duct, a valve piston movable in the cylindrical sleeve, a valve stem connected to the intake valve in the piston cylinder extending through both the intake aperture and the valve piston, a first spring positioned between the valve piston and the piston cylinder, a second spring positioned between the piston cylinder and the end of the valve stem, and a fluid by-pass control device for regulating the amount of fluid passing from the intake duct around the valve piston to the intake aperture.

5 Claims, 14 Drawing Figures

REGULATING THE FLOW CAPACITY OF A POSITIVE DISPLACEMENT PUMP BY CONTROLLING INLET VALVE MEANS

BACKGROUND OF THE INVENTION

1. Field of the Invention

The present invention relates to a method for controlling delivery of fluid from a piston pump which is provided with automatic intake and discharge valves and to a device which can successfully accomplish the method.

2. Description of the Prior Art

Piston pumps, or pumps with positive displacement as they are also called, are employed in several fields in industry and technology where high delivery pressure is required. Such pumps are usually provided with automatic valves wherein the intake and discharge valves are opened by the diminished pressure and increased pressure respectively formed in the pump cylinder during reciprocal movement of the piston therein.

Since the quantity of liquid displaced by the piston of a piston pump during its working stroke is only to a small extent dependent upon the working conditions of the pump, the working pace of the pump, e.g. its shaft speed, must usually be adjustable if it is desired to vary the quantity of liquid delivered from a given pump. In the case of small pumps, especially for the injection of fuel into diesel engines, a known method of regulating the delivery of the pump is to keep the intake valve open during part of the working stroke of the piston so that some of the liquid drawn into the pump cylinder is returned to the intake duct during the working stroke. This can be achieved, for example, by allowing the intake valve to consist of an aperture in the pump cylinder wall which is closed by the pump piston at a given point of time during the working stroke. The closing time can be varied by turning the piston, a cavity in its side wall being arranged so that at the rear it is limited by a surface at an angle to the longitudinal axis of the piston. During the forward movement of the piston, liquid will thus flow out through the inlet aperture via the cavity until its sloping surface has passed the inlet aperture, so that a corresponding proportion of the piston's pumping movement is ineffective. In this system the piston must be rotatively arranged in the cylinder, and rotation of the piston should preferably be controllable from the outside while the pump is running. Moreover, close tolerances are required between piston and cylinder wall in order to achieve sufficient sealing of the intake aperture, and the cavity in the piston makes it impossible to employ sealing piston rings. This system is therefore unsuitable for large piston pumps and for the pumping of liquids with poor lubricating properties.

Another quantity regulation system is known in small pumps, in which the inlet aperture is closed by a moveable valve body. In these pumps a valve body is caused to open after the pump piston has completed part of its forward movement so that contents of the pump cylinder are returned to the inlet duct during the remaining part of the piston stroke. The valve body is moved by a mechanical lifting device which is operated by a variable cam mechanism of relatively complex design. In view of the fact that the valve body has to be moved against the full pressure differential of the pump, the lifting mechanism must be capable of exerting considerable force, which implies costly production and considerable exposure to wear. In addition, the system requires a relatively large amount of energy.

In drilling for natural resources such as, e.g. oil and gas, drilling mud is pumped down through the hollow drill pipe for the purpose of cooling and cleaning the crown and to carry drilling spoil out of the borehole. The drilling mud must often be supplied at very high pressures, and the flow required varies during the drilling operation. Large piston pumps are used for this drilling mud injection, their delivery being regulated by varying the pace of the pump, i.e. its shaft speed.

Where drilling is carried out in a marine environment, e.g. from a floating platform installation, it is usual to use direct current motors to drive the drilling mud pumps in order to be able to vary the pump shaft speed. A direct current motor necessitates highly complicated and sensitive control equipment which requires a great deal of maintenance and a large stock of spares. Besides being costly, the direct current motor and its equipment require considerable space and it is of great weight, thus undesirably affecting the payload of the platform.

The purpose of the present invention is thus to provide a method for the regulation of delivery from a piston pump of the type mentioned by way of introduction, which permits the use of a lighter, less expensive and more rugged alternating current motor for the operation of the pump, while at the same time wholly or partly eliminating the disadvantages of known pumps. Furthermore, it is the purpose of the invention to provide a device to carry out the method.

For a better understanding of the invention it will now be described in detail below with reference to the embodiment shown in the accompanying drawings.

DESCRIPTION OF THE DRAWINGS

FIGS. *1a, 1b, 1c, 2a, 2b, 2c* and *3a, 3b, 3c* diagramatically illustrate the working of the piston pump according to the invention, set for maximum, minimum and medium delivery, respectively.

Figure 1A:
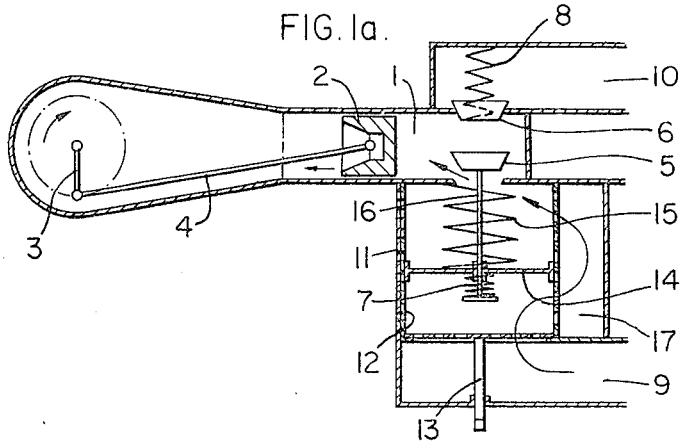

FIGS. *6a, 6b, 6c,* shows part of the device according to the invention in vertical elevation, in partly sectional side elevation, and in folded out respectively.

DESCRIPTION OF THE PREFERRED EMBODIMENTS

The pump shown in FIGS. 1 to 3 comprises a pump cylinder 1 with a pump piston 2 moveable therein, connected to a rotating crankshaft 3 by means of a piston rod 4. In the pump cylinder there is arranged an intake valve 5 and a discharge valve 6, which by means of valve springs 7 and 8 seek to close apertures between the pump cylinder and an intake duct 9 and discharge duct 10, respectively. The valves 5 and 6 act automatically: they open if they are exposed to a pressure differential exceeding the pressures exerted by the valve springs 7 and 8 respectively.

A cylindrical part 11 is arranged in the intake duct adjacent to the pump cylinder, the space therein containing a closely fitting, rotatively arranged sleeve 12 which can be rotated from outside by means of shaft 13. The interior of the sleeve 12 also forms a cylinder in which a sliding valve piston 14 is arranged. Between the valve piston and the pump cylinder there is a valve piston spring 15. Centrally in the valve piston 14 there is a through-running guide for the valve stem 16 of the intake valve 5. The previously mentioned valve spring 7 of the intake valve is disposed between the valve piston 14 and the lower end of the valve stem 16 and forms a flexible connection between the intake valve and the valve piston.

Figure 1B:
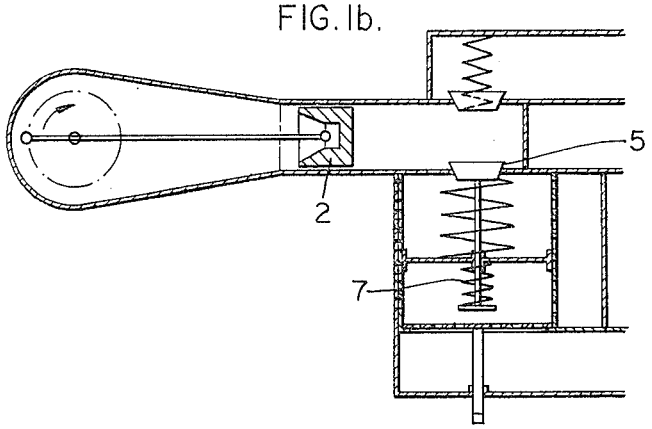
Figure 1C:
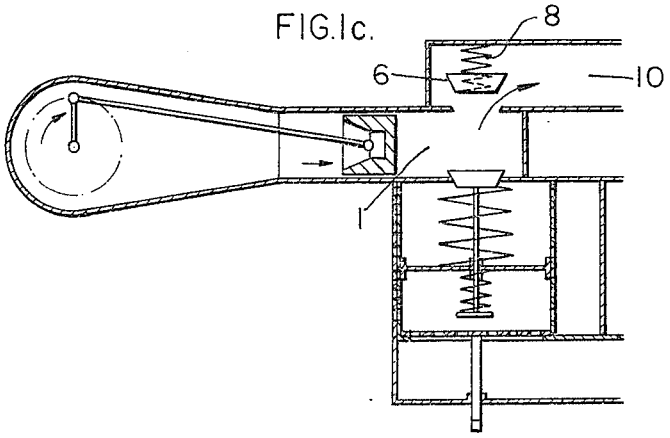

A by-pass duct 17 is arranged at the side of the cylindrical part 11. The part of the wall of cylinder 11 which is adjacent to the by-pass duct 17 is provided with a perforation, and the same applies to the wall of the cylindrical sleeve 12. The perforation of the sleeve 12 is so arranged that it can be brought into register with the perforation of the cylinder 11 over a large or small area by turning the sleeve 12. As shown in FIGS. 1*a*, 1*b* and 1*c*, the perforation of sleeve 12 coincides with the perforation of cylinder 11 throughout their length.

FIG. 1*a* shows the piston on its backward intake stroke. This creates a vacuum in the pump cylinder 1 which causes intake valve 5 to open against the pressure of the valve spring 7, so that liquid can flow as shown by arrows from the intake duct 9 into the sleeve 12 at the underside of the valve piston 14, thence through the perforation into the by-pass duct 17 and on through the perforation into the sleeve 12 on the upper side of the valve piston 14, finally ending in pump cylinder 1.

FIG. 1*b* shows the pump piston 2 in its rearmost position. In this condition there is no longer a vacuum in the pump cylinder 1, and intake valve 5 will therefore close under the pressure of valve spring 7.

FIG. 1*c* shows the pump piston on its forward pumping stroke. This movement creates increased pressure in pump cylinder 1, opening discharge valve 6 against the effect of the valve spring 8 so that liquid can flow into the discharge duct 10.

Figure 2A:
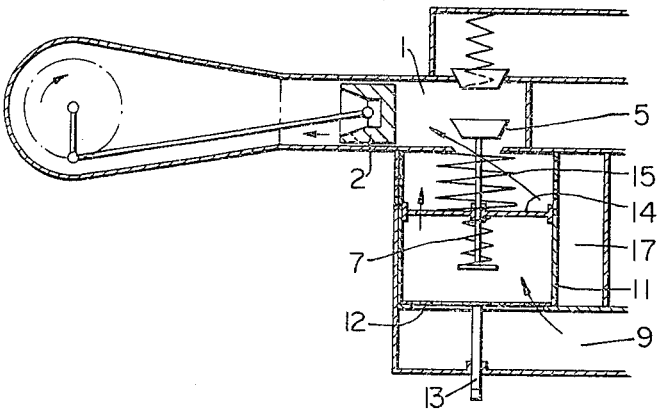
Figure 2B:
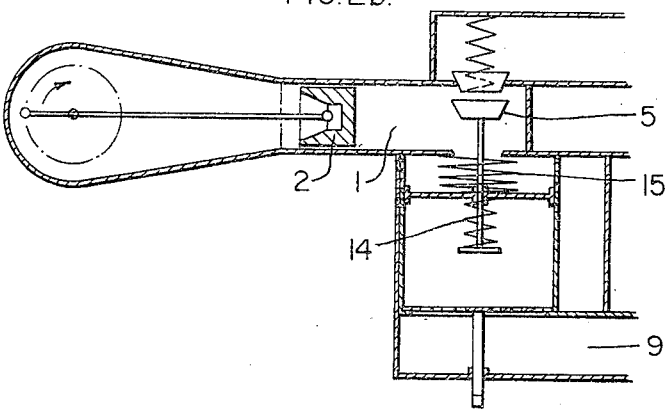
Figure 2C:
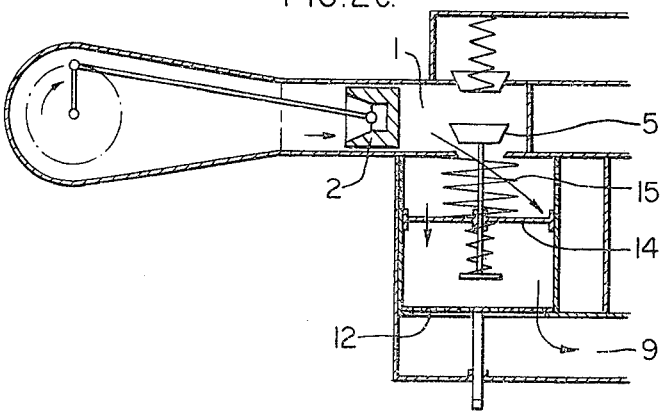

FIGS. 2*a*, 2*b*, 2*c* show the pump according to the invention set for zero delivery.

In this case the cylindrical sleeve 12 is so set by means of the shaft 13 that the perforation of the sleeve 12 and the cylinder 11 do not coincide for a substantial proportion of their perforated surfaces, i.e., there is no connection between the cavity in the cylindrical sleeve 12 and the by-pass duct 17.

FIG. 2*a* shows the pump piston 2 on its backward suction stroke. This creates a lower pressure in the pump cylinder 1 than in the intake duct 9, and this pressure differential causes valve piston 14 and intake valve 5 to move upwards while liquid flows into the pump cylinder 1 from the upper side of the valve piston 14. At the same time liquid flows from the intake duct 9 into the cylindrical sleeve 12 on the underside of the valve piston 14. Since there is no connection between the cavity in the cylindrical sleeve 12 and the by-pass duct 17 on the underside of the valve piston 14, no movement of liquid can take place from the underside to the overside of valve piston 14.

FIG. 2*b* shows pump piston 2 in its rearmost position. Valve piston 14 is kept in its upper position by the pressure differential between the intake duct 9 and the pump cylinder 1 against the pressure of the valve piston spring 15. The intake valve 5 is here in its maximum open position. It will be seen that in this position too there is no connection between the lower side and the upper side of the valve piston 14.

FIG. 2*c* shows the pump piston 2 on its forward pumping stroke. On this stroke liquid flows form the pump cylinder 1 out through the intake valve aperture into the cavity in the cylindrical sleeve 12 on the upper side of the valve piston 14. The valve piston moves downwards under the pressure of valve piston spring 15 and at its underside it forces liquid from the cavity in cylindrical sleeve 12 out into intake duct 9. The movement of the valve piston 14 also causes gradual closing of the intake valve 5, and when the pump piston 2 has reached top dead centre, i.e. the end of its pumping stroke, the valve piston and intake valve will have assumed the position shown in FIGS. 1*b* and 1*c*. Thus, the intake valve 5 only closes when pump piston 2 reaches top dead centre.

Figure 3A:
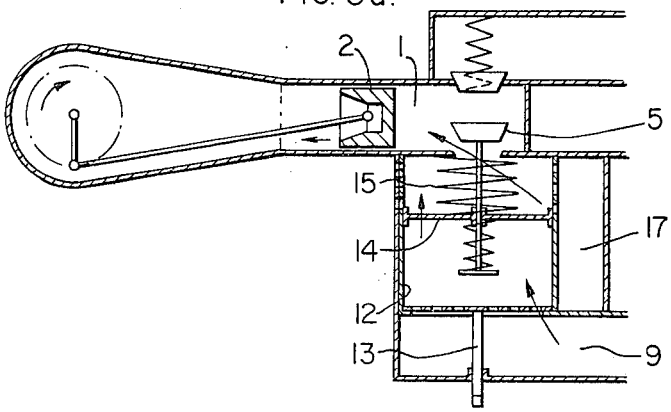
Figure 3B:
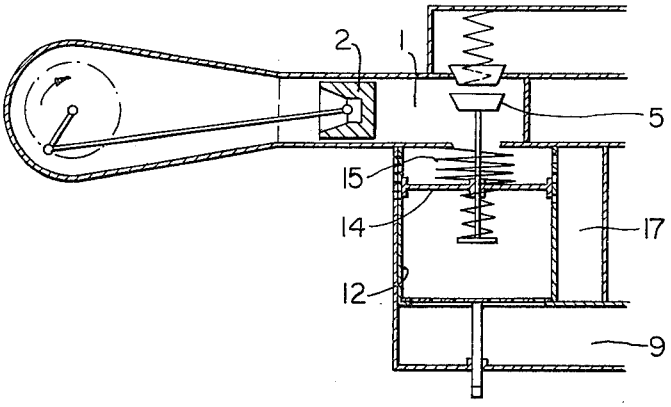
Figure 3C:
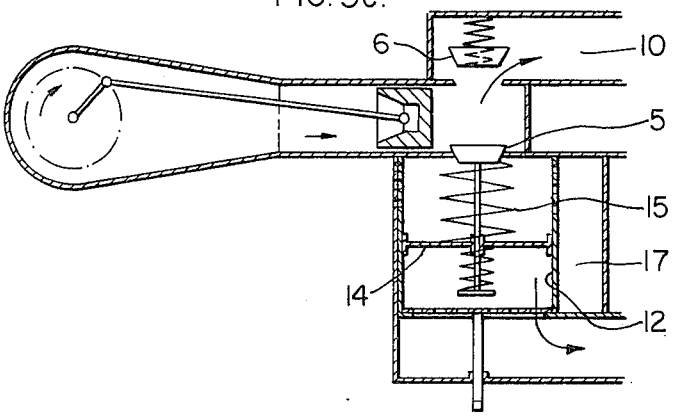

FIGS. 3*a*, 3*b* and 3*c* show the pump according to the the invention, adjusted to delivery slightly less than 50% of full capacity.

This adjustment is effected by turning the shaft 13 so that the perforation of the cylindrical sleeve 12 coincides with the perforation of the by-pass valve 17 for a part of the area of the inner wall of the cylindrical sleeve which valve piston 14 can pass.

FIG. 3*a* shows pump piston 2 on its backward suction stroke. Liquid flows into the pump cylinder 1 from the space in the cylinder sleeve 12 on the upper side of valve piston 14 through the open intake valve 5, while valve piston 14 moves upwards against the pressure of valve piston spring 15. At the same time liquid flows from intake duct 9 into the space in the cylindrical sleeve 12 on the underside of valve piston 14. No liquid has as yet passed from the underside to the upper side of valve piston 14 via by-pass duct 17.

FIG. 3*b* shows the pump according to the invention at the time when pump piston 2 has moved so far back on its suction stroke that the underside of valve piston 14 has uncovered coinciding apertures in the wall of the cylindrical sleeve 12 and the by-pass duct 17. During the remainder of the suction stroke, the valve piston 14 will remain by and large stationary, while liquid flows as shown by the arrow from intake duct 9 to pump cylinder 1 via the cylindrical sleeve 12 and by-pass duct 17.

As soon as the pump piston passes bottom dead center and commences its forward pumping stroke the valve piston 14 will move downwards and close the coinciding apertures on its underside in the wall of the cylindrical sleeve 12 and the by-pass duct 17 by reason of the pressure of the valve piston spring 15 and the liquid flowing out through the open intake valve 5. Valve piston 14 and intake valve 5 will continue to move downwards during the forward pumping stroke of the pump piston until intake valve 5 closes as valve piston 14 reaches its lower position. This position is shown in FIGS. 1*b*, 1*c* and 3*c*. Thereupon, discharge valve 6 will open and liquid will flow out into discharge duct 10 during the remainder of the pump piston's pumping stroke. The liquid thereby flowing out into the discharge duct will be approximately equal to the quantity which during the suction stroke flowed past valve piston 14 via by-pass duct 17, and this is thus the net delivery per stroke of the pump.

Figure 4:
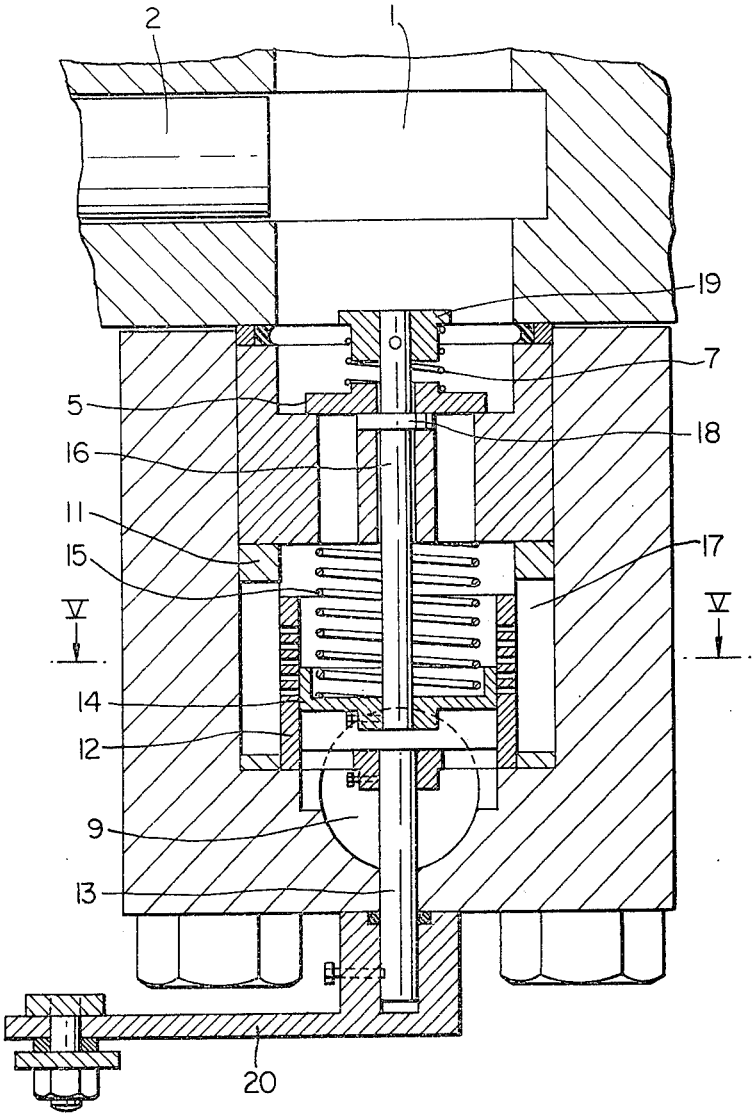
FIG. 4 shows in greater detail a cross section through the intake part of a somewhat modified pump according to the invention, the section being taken along the line IV—IV in FIG. 5.

FIG. 4 shows in greater detail a modified embodiment of the intake part of a pump according to the invention. The reference numbers are the same as those of corresponding parts in FIGS. 1 to 3.

This embodiment deviates from the preceding embodiment in that the valve stem 16 here is in fixed connection with the valve piston 14, while intake valve 5 is arranged to slide on valve stem 16 between a fixed collar 18 on the valve stem and a similarly fixed end flange 19. Intake valve spring 7 is arranged between end flange 19 and intake valve 5 and seeks to move the latter towards collar 18.

Upon upward movement of valve piston 14, the collar 18 will lift intake valve 5 from its seat so that it opens. When valve piston 14 remains at rest in its lower position at 100% delivery, an underpressure in pump cylinder 1 in relation to intake duct 9 will cause intake valve 5 to open against the pressure of valve spring 7.

Shaft 13 for regulation of the cylindrical sleeve 12 is here provided with an actuating arm 20 which may be connected with corresponding actuating arms on further cylinders which the pump may comprise.

Figure 5:
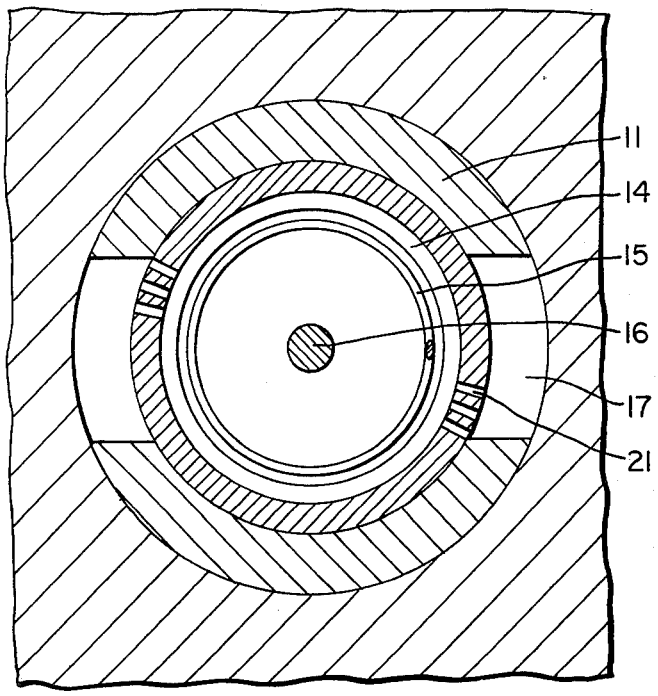
FIG. 5 shows a cross section along the line V—V in FIG. 4.

The cylindrical part 11, wherein sleeve 12 is rotatively arranged, is here provided with 2 large cavities which form the by-pass duct 17. This is more clearly shown in FIG. 5 which shows a cross section along the line V—V in FIG. 4. FIG. 5 similarly shows how, by turning sleeve 12, perforation 21 in its wall can be closed.

Figure 6C:
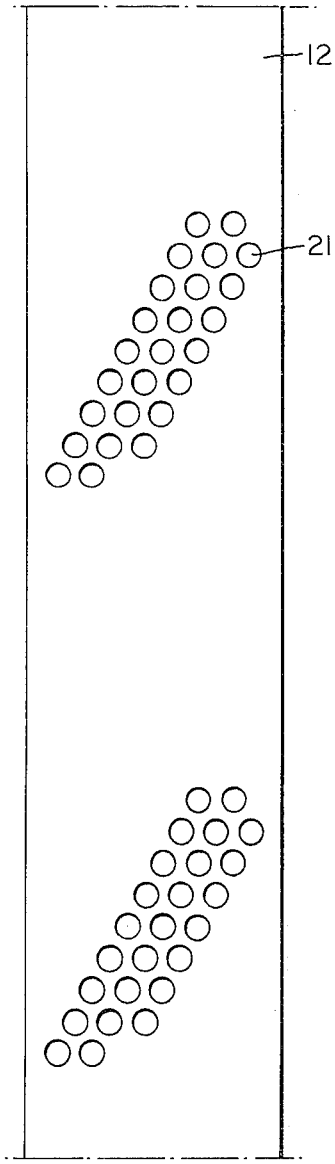
Figure 6B:
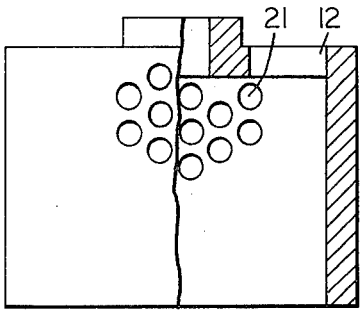
Figure 6A:
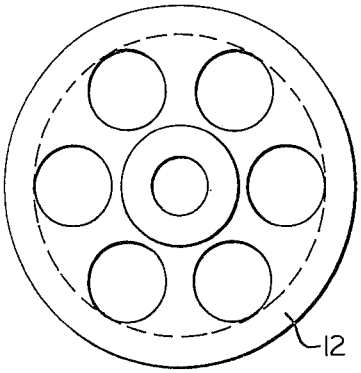

FIG. 6*a* shows the cylindrical sleeve 12 seen from below. FIG. 6*b* shows the sleeve seen from the side, partly in section and FIG. 6*c* shows the side wall of the sleeve, folded out. This clearly shows how perforation 21 is arranged in order to afford valve piston 14 a variable stroke by turning sleeve 12 in relation to the cylindrical part 11.

From the preceding embodiments it will appear that the invention provides a pump of the type mentioned by way of introduction, whose delivery can be continuously regulated by relatively simple means, utilizing the movement of the pumped medium in the intake duct, and without the expenditure of large, energy-wasting internal or external forces.

I claim:

1. A piston pump which can be controlled with respect to its discharge of fluid therefrom which comprises a piston cylinder;

a piston which is reciprocatingly movable in said piston cylinder; said piston being connected to a rotary crankshaft by a piston rod;

a fluid intake duct communicating with said piston cylinder via an intake aperture therein;

a fluid discharge duct communicating with said piston cylinder via a discharge aperture therein;

a discharge valve positionible in said discharge aperture to allow or prevent fluid flow from said piston cylinder to said fluid discharge duct; and means for controlling the flow of fluid from said fluid intake duct through said intake aperture to said piston cylinder, said control means comprising an intake valve positionable in said intake aperture to allow or prevent fluid flow therethrough, a valve piston, means for flexibly connecting said valve piston to said intake valve, a cylindrical sleeve in which said valve piston is movable, said cylindrical sleeve communicating with said intake duct, perforation means in said cylindrical sleeve positioned such that fluid flowing from said intake duct to said piston cylinder through said intake aperture must pass therethrough, and means for adjusting the flow of fluid through said perforation means.

2. The piston pump of claim 1 wherein said means for adjusting the flow of fluid through said perforation means comprises a cylindrical part which is positioned to partially surround said cylindrical sleeve, said cylindrical part and said cylindrical sleeve being movably arranged in relation to one another.

3. The piston pump of claim 2 wherein said means for flexibly connecting said intake valve and said valve piston comprise a valve stem which extends from said intake valve through said valve piston and a first spring positioned between said intake valve and said valve piston so as to act to bias said intake valve to close said intake aperture and prevent fluid flow therethrough.

4. The piston pump of claim 3 wherein said valve stem projects through said intake aperture and into said cylindrical sleeve, said intake valve being positioned in said piston cylinder; wherein said valve piston is movably positioned around said valve stem; wherein said first spring is positioned between said valve piston and said piston cylinder; and wherein a second spring is positioned between said valve piston and the end of said valve stem in said cylindrical sleeve.

5. A method for controlling the delivery of fluid from a piston pump which comprises a piston cylinder, a piston which is reciprocatingly movable in the piston cylinder, a fluid discharge duct, a discharge valve for controlling the discharge of fluid from the piston cylinder through a discharge aperture to the discharge duct, a fluid intake duct, an intake valve for controlling the intake of fluid from the intake duct through an air intake aperture to the piston cylinder, the method comprising positioning a valve piston between the intake duct and the intake aperture and connecting the valve piston to the intake valve such that during the working stroke of the pump piston fluid flows out through the intake aperture and causes the valve piston to move and reposition the intake valve to close the intake aperture, and adjusting the distance which the valve piston must be moved in order to reposition the intake valve to close the intake aperture and thus the quantity of fluid caused to flow out through the discharge aperture and through the discharge duct by regulating the amount of fluid which can freely pass from the fluid intake duct, around the valve piston and through the intake aperture when the intake aperture is open.

* * * * *